United States Patent [19]

Fitzgerald-Smith et al.

[11] 4,453,283

[45] Jun. 12, 1984

[54] DECKING PALLET

[75] Inventors: James P. Fitzgerald-Smith, Ossemsley; Michael Willis, Binstead, both of England

[73] Assignee: The Secretary of State for Defence in Her Britannic Majesty's Government of the United Kingdom of Great Britain and Northern Ireland, London, England

[21] Appl. No.: 432,813

[22] Filed: Oct. 5, 1982

[30] Foreign Application Priority Data

Oct. 5, 1981 [GB] United Kingdom ..... 8130027

[51] Int. Cl.[3] ..... E01D 19/12; E01D 15/12

[52] U.S. Cl. ..... 14/73; 404/37; 404/36; 14/2.4; 52/227; 52/125.2

[58] Field of Search ..... 14/73, 14, 17, 2.4; 404/35, 36, 37, 72; 52/174, 177, 227; 294/67 E, 67 EA

[56] References Cited

U.S. PATENT DOCUMENTS

| | | | |
|---|---|---|---|
| 305,328 | 9/1884 | Peck | 404/37 |
| 2,308,943 | 1/1943 | Tietig et al. | 14/73 X |
| 3,239,265 | 3/1966 | Scibilia | 294/67 E |
| 3,272,269 | 9/1966 | Murphy | 14/73 X |
| 3,685,403 | 8/1972 | Domnick | 404/35 |
| 3,724,078 | 4/1973 | Carlin et al. | 52/177 |
| 3,859,000 | 1/1975 | Webster | 14/73 X |
| 4,037,383 | 7/1977 | Diebold et al. | 52/177 X |
| 4,152,875 | 5/1979 | Soland | 52/227 |
| 4,366,655 | 1/1983 | Mayer et al. | 52/227 |
| 4,376,596 | 3/1983 | Green | 404/35 |

FOREIGN PATENT DOCUMENTS

| | | | |
|---|---|---|---|
| 552796 | 2/1958 | Canada | 52/227 |
| 1209747 | 10/1970 | United Kingdom | 14/17 |

*Primary Examiner*—Ernest R. Purser
*Assistant Examiner*—Beverly E. Hjorth
*Attorney, Agent, or Firm*—Cushman, Darby & Cushman

[57] ABSTRACT

A pallet for use in decking a bridge constructed from girder sections of the type disclosed in Patent No. GB 1209747 comprises a plurality of decking units (1) held in pre-determined disposition by tie bars (7) and spacers (6) so as to engage directly with corresponding recesses (4) in the girder sections (5). The pallet is provided with slinging eyes (9) and may be used to carry additional decking units for manual distribution along the girder sections.

3 Claims, 2 Drawing Figures

DECKING PALLET

Figure 1:
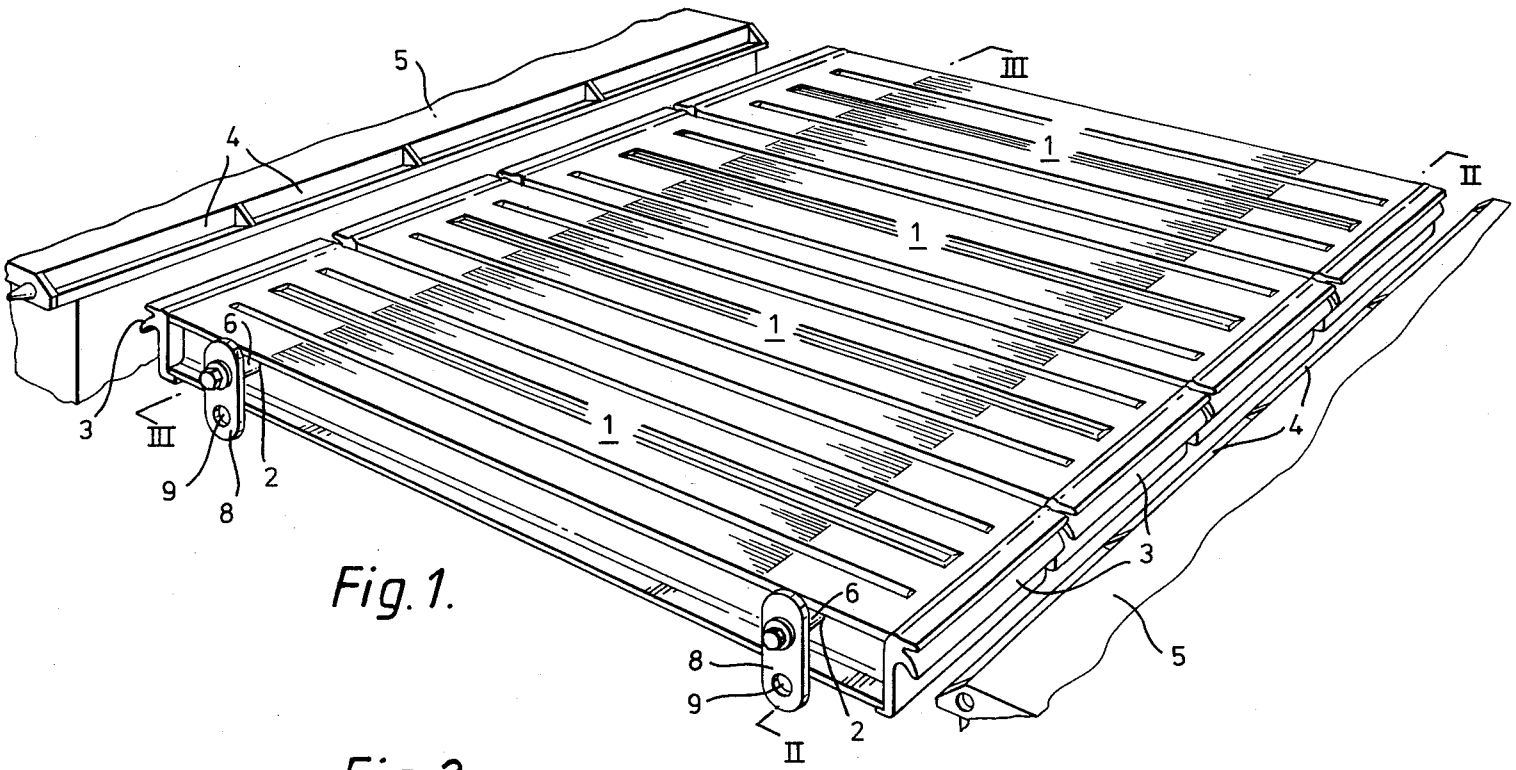

This invention relates to a decking pallet for use in decking a transportable girder bridge built from girder sections of the type described in Pat. No. GB1209747.

Girder sections of the above-mentioned type are connected end to end to form two parallel trackways, the space between them being transversely decked with decking units having hooked locating flanges at each end which engage with corresponding recesses along the inner upper edges of the trackway girder sections. Each decking unit is additionally provided with two anti-displacement holes, each parallel with and adjacent a respective one of the locating flanges. These anti-displacement holes are provided to permit a cable to be serially threaded through the emplaced units to prevent upward displacement from the trackways by forces encountered, for example, during a helicopter lift.

These decking units are normally deployed manually, each one requiring two men to carry it along the trackways and to position it so as to engage its flanges with a selectd pair of opposing recesses in the trackways. Such decking procedure can be very time consuming.

The present invention seeks to provide a decking pallet which will enable the decking units to be more speedily deployed with crane assistance.

Accordingly a decking pallet for use in decking the aforesaid girder sections with the aforesaid decking units, each decking unit having an anti-displacement hole adjacent and parallel to each end, comprises: a plurality of the decking units sequentially disposed in a decking configuration with their anti-displacement holes in alignment so as to form two parallel channels; a tie bar located throughout each channel; a pair of annular spacers interjacent each sequential pair of decking units and respectively located circumjacent each tie bar; and a slinging means attached to each tie bar adjacent each end.

Preferably the slinging means comprises a radial arm freely rotatable about the tie bar and having a slinging eye displaced from the axis of rotation so as to have a locus above deck level. When not supported by slings, the arm rotates under gravity to hang below deck level.

The spacers are dimensioned to ensure that the decking units are spaced so that the whole plurality of decking units can be engaged together in a selected series of girder recesses, when the pallet is slung into place by crane.

The pallet can be slung alone or may also carry further stacked loose decking units to the trackways, these then being distributed manually to adjoining locations.

Conveniently the pallet comprises four interconnected decking units, which number will fully deck a single opposed pair of girder sections in the trackways.

Preferably the material and the dimensions of the tie bar are selected so as to provide that when the pallet is fully loaded and slung the bar will be slightly bowed, thereby to ease engagement of the locating flanges of each decking unit with their respective recesses, the inner two units engaging before the two outer units and their flanges each making an angled entry into its corresponding recess.

Figure 2:
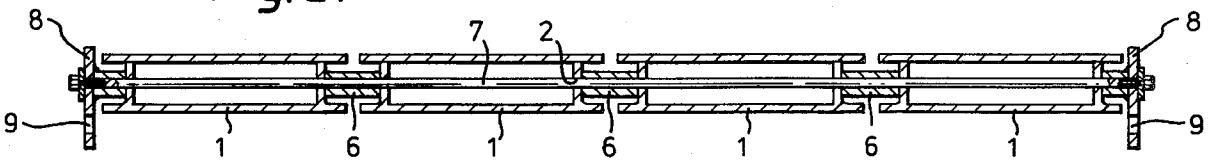

An embodiment of the invention will now be described by way of example only, with reference to the accompanying drawings of which FIG. 1 is an exploded perspective view of a four-unit decking pallet and its associated pair of girder sections, and FIG. 2 is a section taken on either of the lines II—II or III—III of FIG. 1.

The pallet illustrated in FIGS. 1 and 2 comprises four decking units 1 having anti-displacement holes 2 and locating flanges 3 at each end, the flanges being engageable in recesses 4 of adjoining girder sections 5. The units 1 are separated by two sets of annular spacers 6, and a tie bar 7 extends throughout each alternating array of the anti-displacement holes 2 and the spacers 6.

A slinging arm 8 is rotatably attached to each end of each tie bar 7 and is provided with a slinging eye 9 which protrudes above the decking unit when the arm is in an upturned position.

Further decking pallets (not shown) may be stacked three high on each decking unit 1 and the whole assembly lifted and engaged with the girder sections 5 by crane slinging hooks (not shown) inserted into the upturned slinging eyes 9.

We claim:

1. A decking pallet for use in decking a transportable girder bridge of a type constructed form girder sections connected end to end to form two parallel trackways, which trackways are conjointly decked with a series of transverse decking units each having two ends respectively engageable with the two trackways, said girder sections including a series of locating recesses longitudinally spaced apart along upper edges of the girder sections and each of said decking units being provided at each of the said two ends with a hooked locating flange respectively engageable in a confronted pair of the said locating recesses in the two parallel trackways, and further having a through bore extending adjacent each of the two said ends in the longitudinal direction of the trackways, wherein the pallet comprises:

a plurality of said decking units serially disposed with their through bores aligned so as to form two parallel channels, a tiebar disposed throughout each channel havng two ends extending beyond each of the two outermost units respectively, an annular spacer disposed interjacent each sequential pair of decking units and circumjacent each tiebar, the spacer being axially dimensioned so as to provide that the longitudial separation of the locating flanges of the decking units is in accordance with the longitudinal separation of the locating recesses in the girder sections, and a slinging means attached to each of the said ends of the two tiebars so as to be retractable below deck level.

2. A decking pallet as claimed in claim 1 wherein the slinging means comprises a radial arm freely rotatable about the tie bar and having a slinging eye displaced from the axis of rotation so as to have a locus extending above the decking unit.

3. A method of decking a transportable girder bridge of a type constructed from girder sections connected end to end to form two parallel trackways, which trackways are conjointly decked with a series of transverse decking units each having two ends engageable with the two trackways respectively, said girder sections being provided with a series of locating recesses longitudinally spaced along their upper edges and each of said decking units being provided at each of the said two ends with a hooked locating flange respectively engageable in a confronted pair of said locating recesses in the two parallel trackways, and further having a through bore extending adjacent each of the two said ends in the longitudinal directions of the trackways, wherein the method comprises the steps of:

(a) serially predisposing a plurality of said decking units with their through bores aligned so as to form two parallel channels, (b) disposing annular spacers interjacent each sequential pair of decking units in alignment with each of said channels, the spacers being axially dimensioned so as to provide that the longitudinal separation of the locating flanges of the decking units is in accordance with the longitudinal separation of the locating recesses in the girder sections, (c) inserting a tiebar through each channel and the predisposed annular spacers so as to form a pallet, the tiebar having two ends extending beyond each of the two outermost decking units respectively, (d) attaching a slinging means to each of the said ends of the two tiebars so as to be retractable below deck level, and (e) lifting the conjoined plurality of decking units onto the trackways by the slinging means so as to locate and engage all of the said locating flanges conjointly into the respective locating recesses of the girder sections.

* * * * *